US008167827B1

(12) United States Patent
Du Bose

(10) Patent No.: US 8,167,827 B1
(45) Date of Patent: May 1, 2012

(54) COMBINED FLOOR MAT AND CONTINUOUS PASSIVE MOTION DEVICE AND ASSOCIATED METHOD

(76) Inventor: Dan E Du Bose, Brawley, CA (US)

( * ) Notice: Subject to any disclaimer, the term of this patent is extended or adjusted under 35 U.S.C. 154(b) by 917 days.

(21) Appl. No.: 12/218,566

(22) Filed: Jul. 16, 2008

Related U.S. Application Data

(60) Provisional application No. 60/959,485, filed on Jul. 16, 2007.

(51) Int. Cl.
*A61H 1/00* (2006.01)
*A63B 21/04* (2006.01)

(52) U.S. Cl. ..... 601/48; 601/5; 601/23; 601/27; 482/130

(58) Field of Classification Search ..... 601/5, 23, 601/24, 26, 27, 29, 30–35, 84, 86, 87, 89, 601/90, 93, 97, 98, 101, 104; 482/4, 130, 482/133–135, 140, 142, 907
See application file for complete search history.

(56) References Cited

U.S. PATENT DOCUMENTS

| | | | | |
|---|---|---|---|---|
| 5,785,673 | A | 7/1998 | Billotti | |
| 5,843,025 | A | 12/1998 | Shaari | |
| 6,270,445 | B1 * | 8/2001 | Dean et al. | 482/4 |
| 6,936,019 | B2 | 8/2005 | Mason | |

* cited by examiner

*Primary Examiner* — Patricia Bianco
*Assistant Examiner* — George N Phillips

(57) ABSTRACT

The combined floor mat and continuous passive motion device may include a continuous passive motion device and a single and unitary floor mat preferably in continuous frictional contact with the ground surface. The floor mat may be laid end-to-end with the continuous passive motion device so that the proximal end of the continuous passive motion device is adjustably connected to a distal end of the floor mat. The continuous passive motion device may further include a mechanism for preventing the continuous passive motion device from shifting during the exercise so that the floor mat remains longitudinally aligned with the continuous passive motion device and continuously disposed at a flat and planar arrangement on the ground surface.

8 Claims, 3 Drawing Sheets

COMBINED FLOOR MAT AND CONTINUOUS PASSIVE MOTION DEVICE AND ASSOCIATED METHOD

CROSS REFERENCE TO RELATED APPLICATIONS

This application claims the benefit of U.S. Provisional Application No. 60/959,485, filed Jul. 16, 2007, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to rehabilitative treatment devices and, more particularly, to a combined floor mat and continuous passive motion device that remains at a substantially stable and static position during exercising procedures.

2. Prior Art

The proliferation of relatively non-invasive arthroscopic surgical procedures to repair joint and soft tissue injuries and ailments has significantly reduced the duration of post-operative hospital stays for patients of orthopedic surgeries. In many cases the arthroscopic surgical procedures have eliminated altogether the need for post-operative hospital stays. As a result, the bulk of post-operative recovery time from arthroscopic surgical procedures is typically spent in the home. The patient benefits from the familiar surroundings of the home, but usually lacks continuous access to a health care practitioner, which is provided in a hospital.

Nevertheless, it is generally incumbent that the patient receives immediate rehabilitative treatment following a surgical procedure on a joint or soft tissue, particularly when the joint or soft tissue is associated with the knee, elbow or shoulder. The object of the rehabilitative treatment is to restore full range of motion to the involved joint, such as the knee, as soon as possible after a surgical procedure. Such rehabilitative treatments commonly include range of motion exercises which involve controlled movement of the leg without bearing substantial weight or placing an excessive force load on the knee. Unfortunately, the patient often cannot effectively perform such range of motion exercises without external assistance.

Automated motor-driven devices have been developed to assist post-operative patients when performing range of motion exercises with the goal of rehabilitating a joint and restoring range of motion to the joint in the absence of direct assistance from a health care practitioner. Such devices are termed continuous passive motion devices.

Continuous passive motion (CPM) is a rehabilitative treatment method designed to aid in the recovery and to restore full range of motion to the involved joints immediately after trauma or surgery. CPM is carried out by a CPM device, which constantly moves the joint through a controlled range of motion, the exact range is dependent upon the joint, but in most cases the range of motion is increased over time. It is typically an objective of the continuous passive motion device to allow the involved joint to follow a natural anatomical range of motion when the associated limb is moved through the range of motion.

When using CPM devices with knee recoveries, it has been noted that these devices have a tendency to shift from their initial position, which reduces the effectiveness of the CPM device. This shortcoming has not been specifically addressed with examples of prior art in the field of rehabilitative treatment.

U.S. Pat. No. 6,936,019 to Mason discloses a strap connector assembly for an orthopedic brace having a retention post, which has a post cross-sectional dimension, and a chamber, which has a retention aperture. The retention aperture is bounded at least in part by a flexible segment and has an aperture cross-sectional dimension less than the post cross-sectional dimension when the flexible segment is unstressed. However, the aperture cross-sectional dimension is substantially equal to the post cross-sectional dimension when the flexible segment is stressed by the retention post. The retention aperture, flexible segment and retention post cooperatively enable a user to selectively connect or disconnect a strap to or from the orthopedic brace while maintaining the adjustment of the strap. Unfortunately, this prior art example does not provide the user with a floor mat that will remain properly aligned during exercise.

U.S. Pat. No. 5,785,673 to Billotti discloses a brace for supporting a weakened knee joint wherein lower and upper anchor bands are carried by a sleeve for location upon and attachment to the lower leg and the upper leg adjacent the knee joint, with essentially inextensible support straps following respective helical paths around the knee joint between the lower and upper anchor bands, and inflatable elements juxtaposed with the lower and upper anchor bands which subsequently are inflated to anchor the attached lower and upper anchor bands in place for firm and accurate securement upon installation in the desired location and for maintaining the desired location during use. Unfortunately, this prior art example does not provide the user with a means to secure a continuous passive motion device to assist with exercise. Other conventional prior art references have the common problem of shifting side to side while the user is performing psychical therapy and exercise procedures. This is undesirable because it requires the user to stop, during the exercise, and reposition or re align themselves with the continuous passive motion device.

Accordingly, the present invention is disclosed in order to overcome the above noted shortcomings. The combined floor mat and continuous passive motion device is convenient and easy to use, lightweight yet durable in design, and designed for many years of repeated use, making rehabilitative treatment and exercises in the user's home more comfortable and more effective.

BRIEF SUMMARY OF THE INVENTION

In view of the foregoing background, it is therefore an object of the present invention to provide a device for use during exercising procedures. These and other objects, features, and advantages of the invention are provided by a combined floor mat and continuous passive motion device.

The combined floor mat and continuous passive motion device preferably includes a continuous passive motion device. Such a continuous passive motion device may include a foot receiving section advantageously formed at a distal end thereof. The continuous passive motion device may also include a single and unitary floor mat that may have planar top and bottom surfaces. Such a floor mat is preferably laid at an end-to-end pattern with the continuous passive motion device and may further be configured in such a manner that the proximal end of the continuous passive motion device is adjustably connected to a distal end of the floor mat.

The floor mat and the continuous passive motion device may also have a central longitudinal axis coaxially aligned during the exercising procedures. A body of the floor mat is preferably in continuous frictional contact with the ground surface. The continuous passive motion device may further include a mechanism for preventing the continuous passive motion device from undesirably shifting during the exercising procedures so that the floor mat remains longitudinally aligned with the continuous passive motion device and continuously disposed at a flat and planar arrangement on the ground surface.

The preventing mechanism preferably includes first and second flexible straps wrapped about the proximal end of the continuous passive motion device. Such first and second straps may be directly coupled to the distal end of the floor mat. The first and second straps may also be suitably sized and shaped such that the floor mat remain conveniently spaced from the proximal end of the continuous passive motion device and further remain horizontally aligned with the ground surface during the exercising procedures.

The preventing mechanism may also include a plurality of rectilinear locking pins positioned through the first and second flexible straps as well as the distal end of the floor mat respectively such that the distal end of the floor mat may be intercalated between the first and second flexible straps. The first and second straps are preferably spaced apart and juxtaposed about the proximal end of the continuous passive motion device such that the floor mat and the continuous passive motion device effectively maintain a static and fixed relationship with the ground surface as the user executes the exercising procedure.

The preventing mechanism may further include a resilient U-shaped stabilizing arm. Such a stabilizing arm preferably has oppositely situated lateral ends directly mated to the first and second straps respectively. Such lateral ends are preferably laterally biased along mutually exclusive linear paths respectively defined along the proximal end of the continuous passive motion device such that operating forces may be advantageously distributed from the floor mat to the lateral ends thereby preventing the continuous passive motion device from shifting during exercising procedures.

The preventing mechanism may further include a rectilinear anchor lever. Such an anchor lever may be formed from resilient material for absorbing the impact forces during the exercising procedures. The anchor lever may also have axially opposed ends statically and fixedly attached directly to a center region of the stabilizing arm and the proximal end of the continuous passive motion device respectively. The stabilizing arm and anchor lever are preferably seated distally to the straps and away from the distal end of the floor mat. The center region of the stabilizing arm may remain aligned substantially parallel with a center of the proximal end of the continuous passive motion device while the oppositely situated lateral ends of the stabilizing arm may be conveniently displaced with corresponding movements of the first and second straps respectively.

The present invention also provides a method for preventing a continuous passive motion device from undesirably shifting during exercising procedures may include the chronological step of providing and positioning the continuous passive motion device on a ground surface, so that the continuous passive motion device has a foot receiving section formed at a distal end thereof.

The method may also include the step of providing a single and unitary floor mat that has planar top and bottom surfaces and laying the floor mat at an end-to-end pattern with the continuous passive motion device.

The method may further include the step of configuring the floor mat by adjustably connecting a distal end of the floor mat to the proximal end of the continuous passive motion device such that the body of the mat maintains continuous frictional contact with the ground surface.

The method may finally include the step of preventing the continuous passive motion device from undesirably shifting during the exercising procedures by retaining the floor mat at a longitudinally aligned arrangement with the continuous passive motion device such that the floor mat remains continuously disposed at a flat and planar arrangement on the ground surface.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
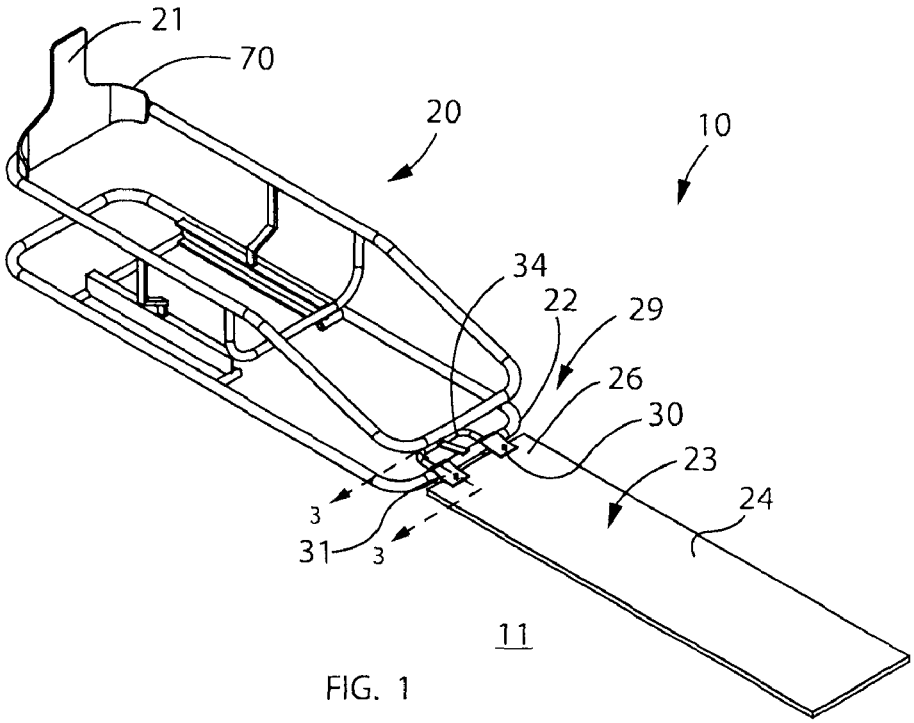
FIG. 1 is a perspective view of a combined floor mat and continuous passive motion device, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The device of this invention is referred to generally in FIGS. 1-5 by the reference numeral 10 and is intended to provide a combined floor mat and continuous passive motion device. It should be understood that the device 10 may be used during many different types of exercise procedures and should not be limited in use to only exercise procedures involving specific types of rehabilitative therapy.

Referring initially to FIGS. 1-5, the combined floor mat and continuous passive motion device 10 preferably includes a continuous passive motion device 20. Such a continuous passive motion device 20 may include a foot receiving section 21 advantageously formed at a distal 70 end thereof. The present invention also includes a single and unitary floor mat 23 that may have planar top and bottom surfaces 24, 25. Such a floor mat 23 is preferably laid at an end-to-end pattern with the continuous passive motion device 20 and may further be configured in such a manner that the proximal end 22 of the continuous passive motion device 20 is adjustably connected to a distal end 26 of the floor mat 23, which is essential to prevent the floor mat 23 from moving away from the continuous passive motion device 20 during exercise procedures.

The floor mat 23 and the continuous passive motion device 20 may also have a central longitudinal axis 27 coaxially aligned during the exercising procedures. A body 28 of the floor mat 23 is preferably in continuous frictional contact with the ground surface 11 for preventing the body 28 from wrinkling or crimping during exercise procedures.

The present invention 10 may further include a mechanism for preventing 29 the continuous passive motion device 20 from undesirably shifting during the exercising procedures which is critical so that the floor mat 23 remains longitudinally aligned with the continuous passive motion device 20 and continuously disposed at a flat and planar arrangement on the ground surface 11. The combination of such claimed elements provides an unpredictable and unexpected result which is not rendered obvious by one skilled in the art, wherein a user may remain properly aligned with the continuous passive motion device 20 during exercise procedures, thus resulting in more effective exercise.

Figure 2:
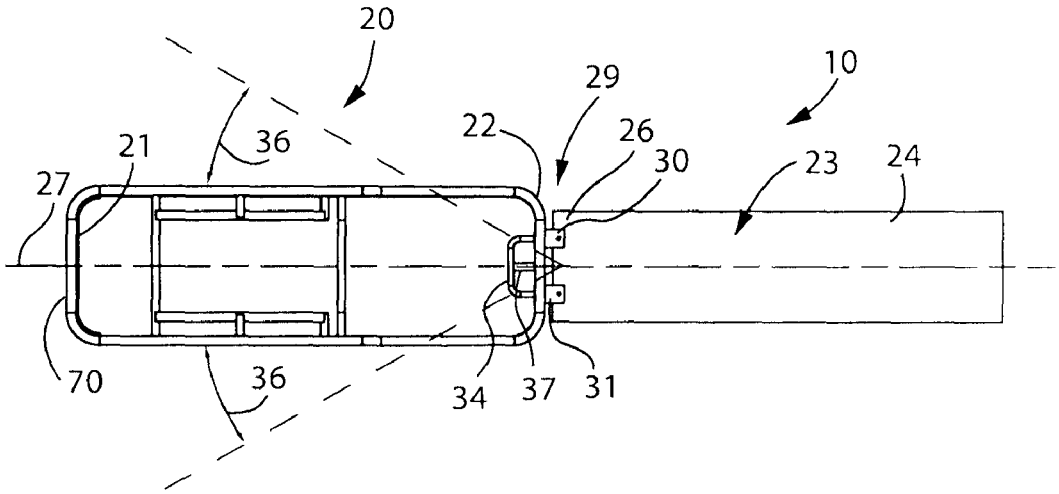
FIG. 2 is a top plan view showing a central longitudinal axis of the combined floor mat and continuous passive motion device.
Figure 3:
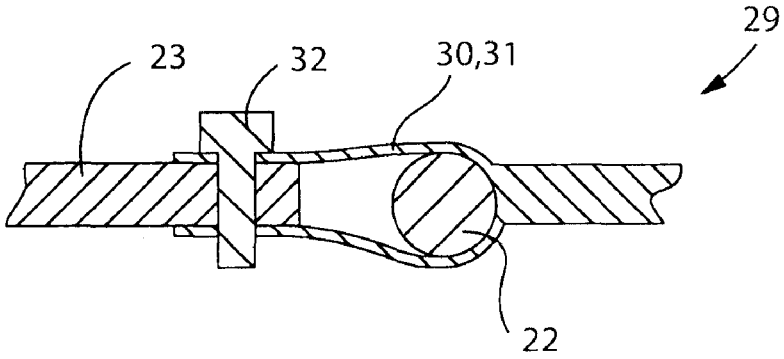
FIG. 3 is an enlarged cross-section view showing the flexible straps directly coupled to the distal end of the floor mat and wrapped about the proximal end of the continuous passive motion device, taken along line 3-3, as shown in FIG. 1.
Figure 4:
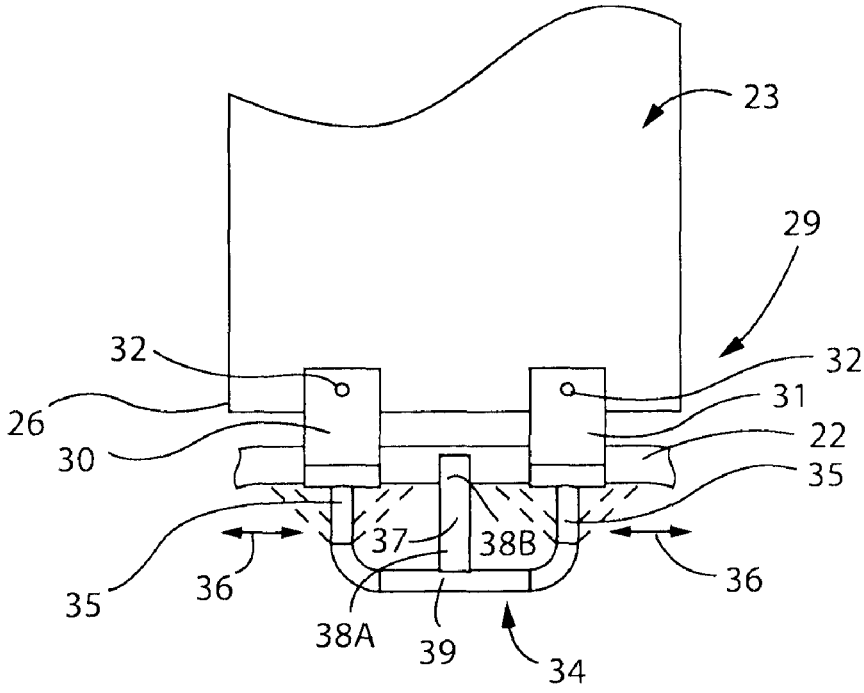
FIG. 4 is an enlarged top plan view showing how the lateral ends of the stabilization arm linearly slide in sync with the first and second straps of the combined floor mat and continuous passive motion device.
Figure 5:
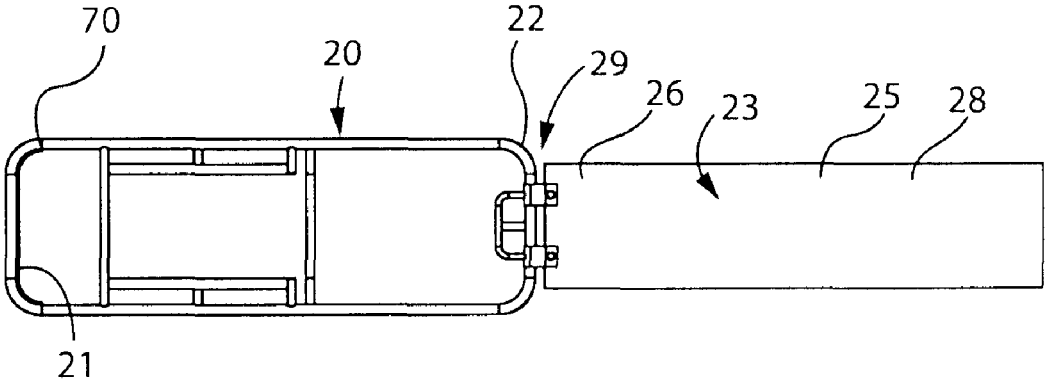
FIG. 5 is a bottom plan view of the combined floor mat and continuous passive motion device, in accordance with the present invention.

Referring to FIGS. 1, 2, and 4, the preventing mechanism 29 preferably includes first and second flexible straps 30, 31 wrapped about the proximal end 22 of the continuous passive motion device 20. Such first and second straps 30, 31 may be directly coupled, without the use of intervening parts, to the distal end 26 of the floor mat 23.

The first and second straps 30, 31 may also be suitably sized and shaped which is crucial such that the floor mat 23 remain advantageously spaced from the proximal end 22 of the continuous passive motion device 20 and further remain horizontally aligned with the ground surface 11 during the exercising procedures. While the ground surface is not shown, reference numeral 11 is provided as a general indication of where the ground surface may be oriented with respect to the floor mat 23 and device 20. One skilled in the art understands that the term "ground surface" may include a variety of floors or substrates that are planar and smooth for maintaining frictional engagement with the floor mat 23.

Referring to FIGS. 1-4, the preventing mechanism 29 may also include a plurality of rectilinear locking pins 32 positioned through the first and second flexible straps 30, 31 as well as the distal end 26 of the floor mat 23 respective which is vital such that the distal end 26 of the floor mat 23 may be intercalated between the first and second flexible straps 30, 31. The first and second straps 30, 31 are preferably spaced apart and juxtaposed about the proximal end 22 of the continuous passive motion device 20 which is necessary such that the floor mat 23 and the continuous passive motion device 20 effectively maintain a static and fixed relationship with the ground surface 11 as the user executes the exercising procedure. The combination of such claimed elements provides an unpredictable and unexpected result which is not rendered obvious by one skilled in the art, wherein the user may engage the continuous passive movement device 20 during exercise without the need to periodically stop and reposition the device 20 due to undesirable shifting thereof.

Referring to FIGS. 1-5, the preventing mechanism 29 may further include a resilient U-shaped stabilizing arm 34. Such a stabilizing arm 34 preferably has oppositely situated lateral ends 35 directly mated, without the use of intervening elements, to the first and second straps 30, 31 respectively. Such lateral ends 35 are preferably laterally biased along mutually exclusive linear paths 36 respectively defined along the proximal end 22 of the continuous passive motion device 20, which is necessary, so that operating forces may be advantageously distributed from the floor mat 23 to the lateral ends 35 thereby preventing the continuous passive motion device 20 from undesirably shifting during exercising procedures. FIG. 4 shows the lateral movements of the lateral ends 35. It is understood that the straps 30, 31 move in sync with such lateral ends 35 and reciprocate along the proximal end 22 of the device 20.

Referring to FIGS. 2 and 4, the preventing mechanism 29 may further include a rectilinear anchor lever 37. Such an anchor lever 37 may be formed from resilient material for absorbing the impact forces during the exercising procedures. Of course, the anchor lever 37 may be formed from a variety of resilient materials, as is obvious to a person of ordinary skill in the art. The anchor lever 37 may also have axially opposed ends 38A, 38B statically and fixedly attached directly, without the use of intervening elements, to a center region 39 of the stabilizing arm 34 and the proximal end 22 of the continuous passive motion device 20 respectively.

The stabilizing arm 34 and anchor lever 37 are preferably seated distally to the straps 30, 31 and away from the distal end 26 of the floor mat 23. The center region 39 of the stabilizing arm 34 may remain aligned substantially parallel with a center of the proximal end 22 of the continuous passive motion device 20 while the oppositely situated lateral ends 35 of the stabilizing arm 34 may be conveniently displaced with corresponding movements of the first and second straps 30, 31 respectively. The combination of such claimed elements provides an unpredictable and unexpected result which is not rendered obvious by one skilled in the art wherein the operating forces being distributed from the floor mat 23 to the lateral ends 35 thereby preserving the life of the floor mat 23 and saving the user money, by preventing the device 20 from undesirably shifting during exercise procedures.

The present invention, as claimed, provides the unexpected and unpredictable benefit of advantageously anchoring the continuous passive motion device during exercise procedures, which is greatly appreciated by any user who has undergone knee surgery and needs to utilize a continuous passive motion device during their course of physical therapy. By maintaining the continuous passive motion device in proper alignment with the user's body, the device ensures that the continuous passive motion device engages and moves the affected joint through the correct range of motion for the desired amount of time, which can result in a more expedient recovery with fewer complications.

In use, a method for preventing a continuous passive motion device 20 from undesirably shifting during exercising procedures may include the step of providing and positioning the continuous passive motion device 20 on a ground surface 11, so that the continuous passive motion device 20 has a foot receiving section 21 formed at a distal 70 end thereof.

In use, the method may also include the step of providing a single and unitary floor mat 23 that has planar top and bottom surfaces 24, 25 and laying the floor mat 23 at an end-to-end pattern with the continuous passive motion device 20.

In use, the method may further include the step of configuring the floor mat 23 by adjustably connecting a distal end 26 of the floor mat 23 to the proximal end 22 of the continuous passive motion device 20 such that the body of the mat 28 maintains continuous frictional contact with the ground surface.

In use, the method may finally include the step of preventing the continuous passive motion device 20 from undesirably shifting during the exercising procedures by retaining the floor mat 23 at a longitudinally aligned arrangement with the continuous passive motion device 20 such that the floor mat 23 remains continuously disposed at a flat and planar arrangement on the ground surface 20.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A combined floor mat and device for use during exercising procedures, said combined floor mat and device comprising:

a device having a foot receiving section formed at a distal end thereof;

a single and unitary floor mat having planar top and bottom surfaces, said floor mat being laid at an end-to-end pattern with said device and further being configured in such a manner that said proximal end of said device is adjustably connected to a distal end of said floor mat; and means for preventing said device from undesirably shifting during the exercising procedures so that said floor mat remains longitudinally aligned with said device and continuously disposed at a flat and planar arrangement on the ground surface;

wherein said preventing means comprises first and second flexible straps wrapped about said proximal end of said device, each of said first and second straps being directly coupled to said distal end of said floor mat, each of said first and second straps being suitably sized and shaped such that said floor mat remains spaced from said proximal end of said device and further remains horizontally aligned with the ground surface during the exercising procedures;

wherein said preventing means further comprises a plurality of rectilinear locking pins positioned through said first and second flexible straps as well as said distal end of said floor mat respectively such that said distal end of said floor mat is intercalated between said first and second flexible straps;

wherein said first and second straps spaced apart and juxtaposed about said proximal end of said device such that said floor mat and said device maintain a static and fixed relationship with the ground surface as the user executes the exercising procedures;

wherein said preventing means further comprises a resilient U-shaped stabilizing arm having oppositely situated lateral ends directly mated to said first and second straps respectively, said lateral ends being laterally biased along mutually exclusive linear paths respectively defined along said proximal end of said device such that operating forces are distributed from said floor mat to said lateral ends thereby preventing said device from shifting during exercising procedures;

wherein said preventing means further comprises a rectilinear anchor lever having axially opposed ends statically and fixedly attached directly to a center region of said stabilizing arm and said proximal end of said device respectively, said center region of said stabilizing arm remaining aligned substantially parallel with a center of said proximal end of said device while said oppositely situated lateral ends of said stabilizing arm are displaced with corresponding movements of said first and second straps respectively.

2. The combined floor mat and device of claim 1, wherein said stabilizing arm and said anchor lever are seated distally of said straps and away from said distal end of said floor mat.

3. The combined floor mat and device of claim 2, wherein said anchor lever is formed from resilient material for absorbing the impact forces during the exercising procedures.

4. The combined floor mat and device of claim 1, wherein each of said floor mat and said device has a central longitudinal axis coaxially aligned during the exercising procedures.

5. A combined floor mat and device for use during exercising procedures, said combined floor mat and device comprising:

a device having a foot receiving section formed at a distal end thereof;

a single and unitary floor mat having planar top and bottom surfaces, said floor mat being laid at an end-to-end pattern with said device and further being configured in such a manner that said proximal end of said device is adjustably connected to a distal end of said floor mat, said floor mat maintaining continuous frictional contact with the ground surface; and means for preventing said device from undesirably shifting during the exercising procedures so that said floor mat remains longitudinally aligned with said device and continuously disposed at a flat and planar arrangement on the ground surface;

wherein said preventing means comprises first and second flexible straps wrapped about said proximal end of said device, each of said first and second straps being directly coupled to said distal end of said floor mat, each of said first and second straps being suitably sized and shaped such that said floor mat remains spaced from said proximal end of said device and further remains horizontally aligned with the ground surface during the exercising procedures;

wherein said preventing means further comprises a plurality of rectilinear locking pins positioned through said first and second flexible straps as well as said distal end of said floor mat respectively such that said distal end of said floor mat is intercalated between said first and second flexible straps;

wherein said first and second straps spaced apart and juxtaposed about said proximal end of said device such that said floor mat and said device maintain a static and fixed relationship with the ground surface as the user executes the exercising procedures;

wherein said preventing means further comprises a resilient U-shaped stabilizing arm having oppositely situated lateral ends directly mated to said first and second straps respectively, said lateral ends being laterally biased along mutually exclusive linear paths respectively defined along said proximal end of said device such that operating forces are distributed from said floor mat to said lateral ends thereby preventing said device from shifting during exercising procedures;

wherein said preventing means further comprises a rectilinear anchor lever having axially opposed ends statically and fixedly attached directly to a center region of said stabilizing arm and said proximal end of said device respectively, said center region of said stabilizing arm remaining aligned substantially parallel with a center of said proximal end of said device while said oppositely situated lateral ends of said stabilizing arm are displaced with corresponding movements of said first and second straps respectively.

6. The combined floor mat and device of claim 5, wherein said stabilizing arm and said anchor lever are seated distally of said straps and away from said distal end of said floor mat.

7. The combined floor mat and device of claim 6, wherein said anchor lever is formed from resilient material for absorbing the impact forces during the exercising procedures.

8. The combined floor mat and device of claim 5, wherein each of said floor mat and said device has a central longitudinal axis coaxially aligned during the exercising procedures.

* * * * *